US009848686B2

(12) United States Patent
Doubleday

(10) Patent No.: US 9,848,686 B2
(45) Date of Patent: Dec. 26, 2017

(54) PACK HAVING ONE-PIECE SEAMLESS BODYSIDE LINER

(71) Applicant: American Recreation Products, Inc., Boulder, CO (US)

(72) Inventor: Erin E. Doubleday, Berthoud, CO (US)

(73) Assignee: Exxel Outdoors, LLC, Boulder, CO (US)

( * ) Notice: Subject to any disclaimer, the term of this patent is extended or adjusted under 35 U.S.C. 154(b) by 63 days.

(21) Appl. No.: 14/703,030

(22) Filed: May 4, 2015

(65) Prior Publication Data

US 2015/0313346 A1 Nov. 5, 2015

Related U.S. Application Data

(60) Provisional application No. 61/988,531, filed on May 5, 2014.

(51) Int. Cl.

| | |
|---|---|
| ***A45F 3/04*** | (2006.01) |
| ***A45F 3/14*** | (2006.01) |
| ***A45F 3/12*** | (2006.01) |
| *A45F 3/00* | (2006.01) |

(52) U.S. Cl.

CPC ..... *A45F 3/04* (2013.01); *A45F 3/12* (2013.01); *A45F 3/14* (2013.01); *A45F 2003/001* (2013.01); *A45F 2003/146* (2013.01)

(58) Field of Classification Search

CPC ..... A45F 3/04; A45F 3/12; A45F 3/14; A45F 2003/001; A45F 2003/146; A45F 2003/007; A45F 2003/025; A45F 2003/045

See application file for complete search history.

(56) References Cited

U.S. PATENT DOCUMENTS

| | | | | |
|---|---|---|---|---|
| 5,361,412 | A * | 11/1994 | Perry | A41D 13/0012 2/102 |
| D603,158 | S * | 11/2009 | Lown | D2/839 |
| 9,125,479 | B2 * | 9/2015 | Chapuis | A45F 3/04 |
| 2002/0179653 | A1 * | 12/2002 | Klamm | A45F 3/04 224/153 |
| 2010/0116861 | A1 * | 5/2010 | Burrowes | A45F 3/04 224/633 |
| 2011/0042436 | A1 * | 2/2011 | Rich | A45C 13/002 224/645 |
| 2011/0120893 | A1 * | 5/2011 | Rekuc | A45C 13/021 206/320 |

* cited by examiner

*Primary Examiner* — Corey Skurdal

(74) *Attorney, Agent, or Firm* — Stinson Leonard Street LLP

(57) ABSTRACT

A backpack which includes at least one panel defining an interior compartment adapted to store objects for transport in the backpack, wherein the at least one panel has a bodyfacing surface. The backpack further includes a pair of shoulder straps attached to the at least one panel for use in carrying the backpack on a user's back, each of the shoulder straps having another bodyfacing surface. A bodyside liner covers the bodyfacing surfaces of the at least one panel and the pair of shoulder straps. The bodyside liner is free from attachment to the at least one panel and the shoulder straps except along a peripheral edge of the bodyside liner, wherein the peripheral edge of the bodyside liner is attached to the at least one panel and the pair of the shoulder straps.

20 Claims, 18 Drawing Sheets

PACK HAVING ONE-PIECE SEAMLESS BODYSIDE LINER

CROSS-REFERENCE TO RELATED APPLICATION

This nonprovisional application claims priority to U.S. Provisional Patent Application Ser. No. 61/988,531, filed on May 5, 2014, which is hereby incorporated by reference in its entirety.

FIELD

The field of this disclosure relates generally to packs used to facilitate carrying a load by a user and, more particularly, to a pack having a one-piece, seamless bodyside liner to facilitate user comfort.

BACKGROUND

Conventional backpacks typically include a plurality of panels stitched together to cooperatively define an interior compartment adapted to store objects for transport in the backpack and include a pair of shoulder straps attached to one or more of the panels for carrying the backpack on a user's back. The interior compartment is often selectively accessible by moving a suitable fastening system comprising one or more suitable fasteners (e.g., a slide fastener, straps, hook and loop, snaps, buttons) between a closed position and an opened position. In addition to the interior compartment, known backpacks may also have interior and/or exterior pockets for holding additional objects for transport in the backpack. In some configurations, these pockets are selectively moveable between closed and opened positions using any suitable fastening system. In other configurations, the pockets are open and thus, not selectively closeable.

Known backpacks often have a liner or other suitable material that covers the portion of the backpack adapted to face the user during use. More specifically, the bodyfacing surface of the shoulder straps and the bodyfacing surface of one or more of the panels may include a liner adapted for placement against the user during use of the backpack. However, known liners comprise a number of segments (e.g., not a single-piece) and are stitched (i.e., not seamless) to the underlying structure. During use, the edges of these liner segments and the stitching can irritate the skin of the user. For example, if a runner is using such a backpack and wearing a relatively light weight shirt or no shirt, the edges of the liner segments and/or the stitching can rub against the skin of the user while he/she is running causing chaffing, abrasion, a rash, or other skin irritation.

In view of the above drawbacks, there remains a need for a backpack having a liner that inhibits skin irritation, such as chaffing, abrasion or rash, during use of the backpack while providing comfort, durability, moisture resistance, stain resistance, and odor resistance.

BRIEF DESCRIPTION

In one aspect, a backpack is provided. The backpack includes at least one panel defining an interior compartment adapted to store objects for transport in the backpack, wherein the at least one panel has a bodyfacing surface. The backpack further includes a pair of shoulder straps attached to the at least one panel for use in carrying the backpack on a user's back, each of the shoulder straps having another bodyfacing surface. A bodyside liner covers the bodyfacing surfaces of the at least one panel and the pair of shoulder straps. The bodyside liner is free from attachment to the at least one panel and the shoulder straps except along a peripheral edge of the bodyside liner, wherein the peripheral edge of the bodyside liner is attached to the at least one panel and the pair of the shoulder straps.

In another aspect, a backpack is provided. The backpack includes at least one panel defining an interior compartment adapted to store objects for transport in the backpack, wherein the at least one panel has a bodyfacing surface. A pair of shoulder straps is attached to the at least one panel for use in carrying the backpack on a user's back, each of the shoulder straps having another bodyfacing surface. A one-piece bodyside liner has a body portion, a pair of strap portions, and a peripheral edge coupled to the body portion and the pair of strap portions. The body portion covers the bodyfacing surface of the at least one panel and the strap portions cover the bodyfacing surfaces of the shoulder straps. The one-piece bodyside liner is free from attachment to the at least one panel and the shoulder straps except along the peripheral edge which is configured to attach to the at least one panel and the pair of shoulder straps.

In a further aspect, a backpack is provided. The backpack includes at least one panel defining an interior compartment adapted to store objects for transport in the backpack, wherein the at least one panel has a bodyfacing surface. A pair of shoulder straps are attached to the at least one panel for use in carrying the backpack on a user's back, each of the shoulder straps having another bodyfacing surface. A bodyside liner has a body portion, a pair of strap portions, and a peripheral edge, wherein the body portion covers the bodyfacing surface of the at least one panel and the strap portions cover the body facing surfaces of the shoulder straps. The bodyside liner is free from attachment to the at least one panel and the shoulder straps except along the peripheral edge, wherein the peripheral edge of the bodyside liner is attached to the at least one panel and the pair of shoulder straps. An edge binding is disposed about at least about a portion of the peripheral edge.

In yet another aspect, a one-piece bodyside liner for a pack, which includes a bodyfacing surface, is provided. The one-piece bodyside liner includes a body portion covering the bodyfacing surface and being free from attachment to the bodyfacing surface except along a peripheral edge of the body portion. The peripheral edge of the one-piece bodyside liner is configured to attach to the bodyfacing surface

DETAILED DESCRIPTION OF THE DRAWINGS

Figure 1:
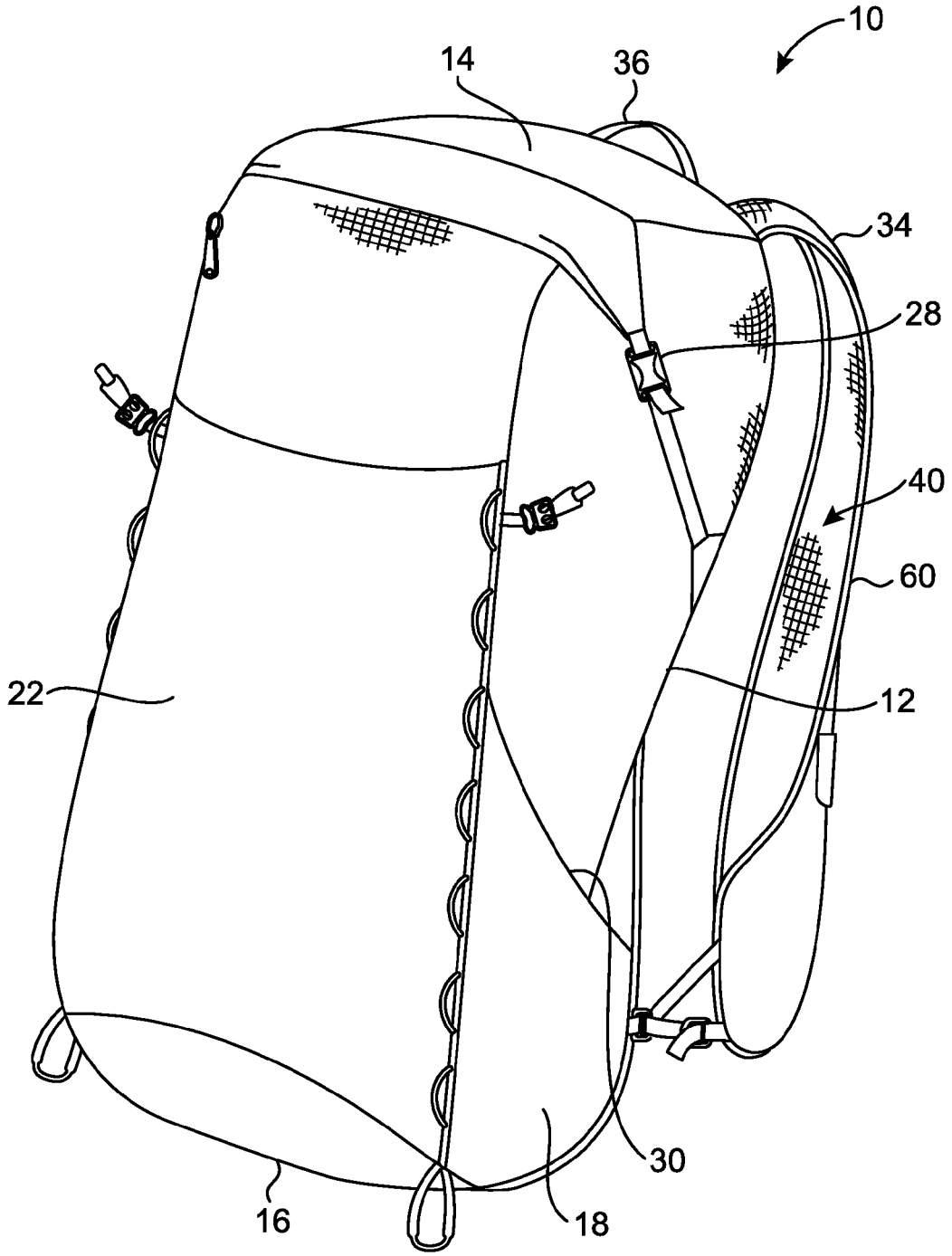
FIG. 1 is a front perspective of one suitable embodiment of a backpack of the present disclosure.
Figure 2:
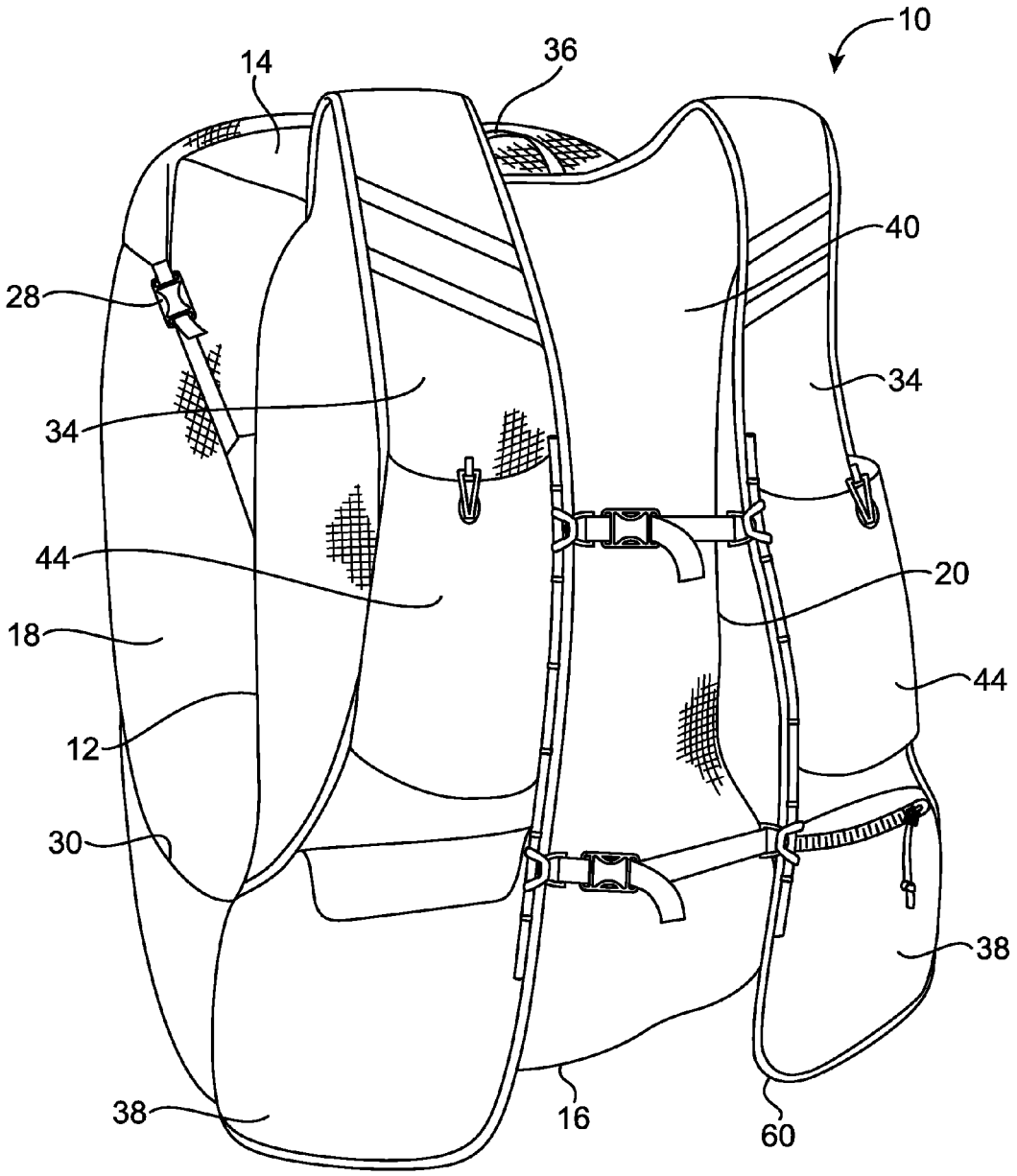
FIG. 2 is a rear perspective of the backpack of FIG. 1.

With reference now to the drawings, FIGS. 1-5 illustrate one suitable embodiment of a pack of the present invention in the form of a backpack, indicated generally at 10. The backpack 10 includes a back panel 12, a top panel 14, a bottom panel 16, two side panels (for example, a right side panel 18 and a left side panel 20), and a front panel 22. The panels 16, 18, 20, and 22 cooperatively define at least one interior compartment (not shown) adapted to store objects (not shown) for transport in the backpack 10. In the illustrated embodiment, the interior compartment can be accessed by moving the top panel 14 from a closed position (FIGS. 1-5) to an opened position (not shown). The top panel 14 can be secured in the closed position using any suitable fastening system comprising one or more suitable fasteners (for example, buckles 28) as seen in FIGS. 1 and 2. It is understood that the any suitable fasteners (for example, a slide fastener, straps, hook and loop, snaps, buttons) can be used to secure the top panel 14 in the closed position. It is also understood that the interior compartment can be accessed in a different matter (for example, using a slide fastener to separate one or more of the panels 16, 18, 20, and 22) without departing from some aspects of this disclosure.

Figure 3:
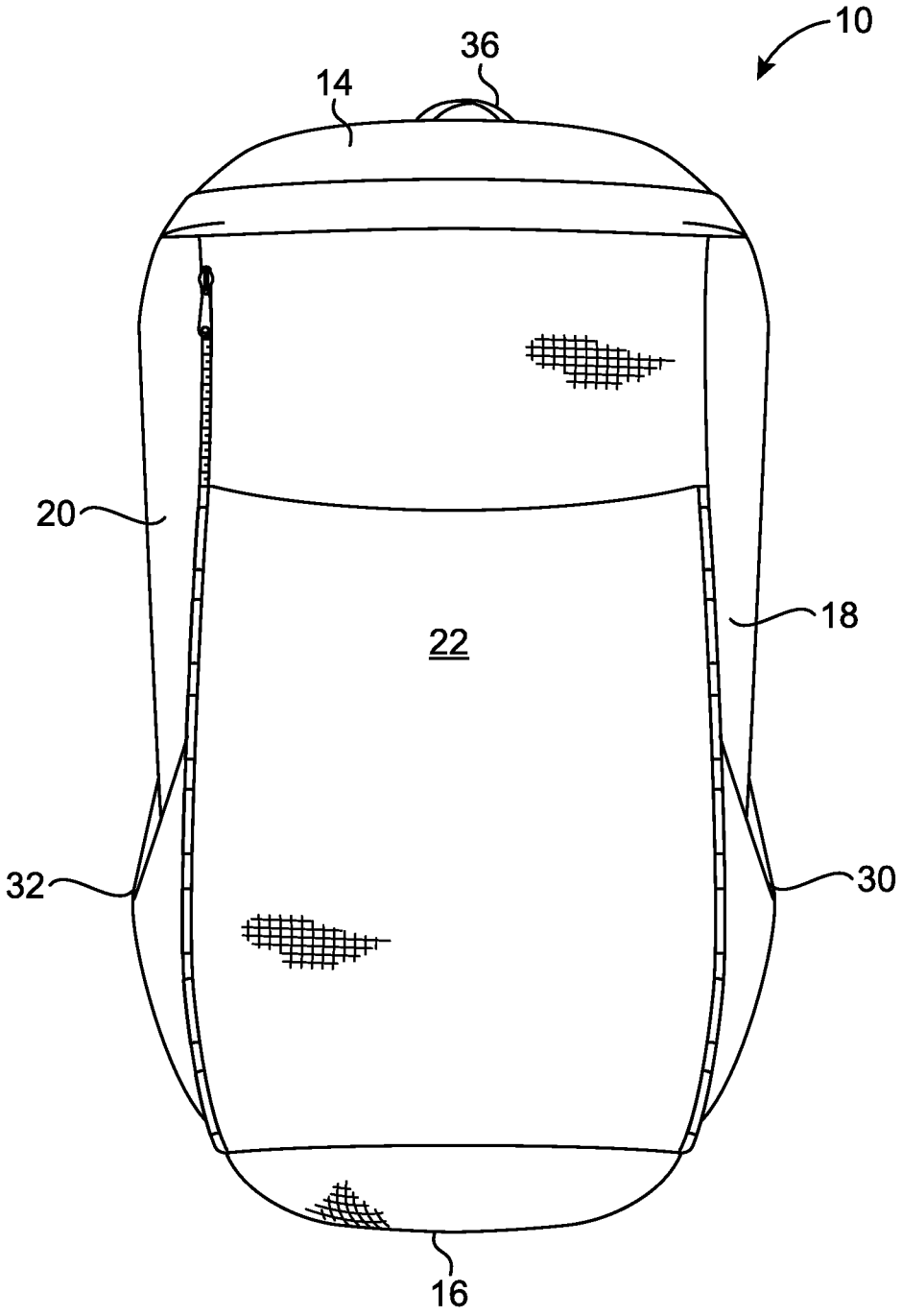
FIG. 3 is a front elevation of the backpack.
Figure 4:
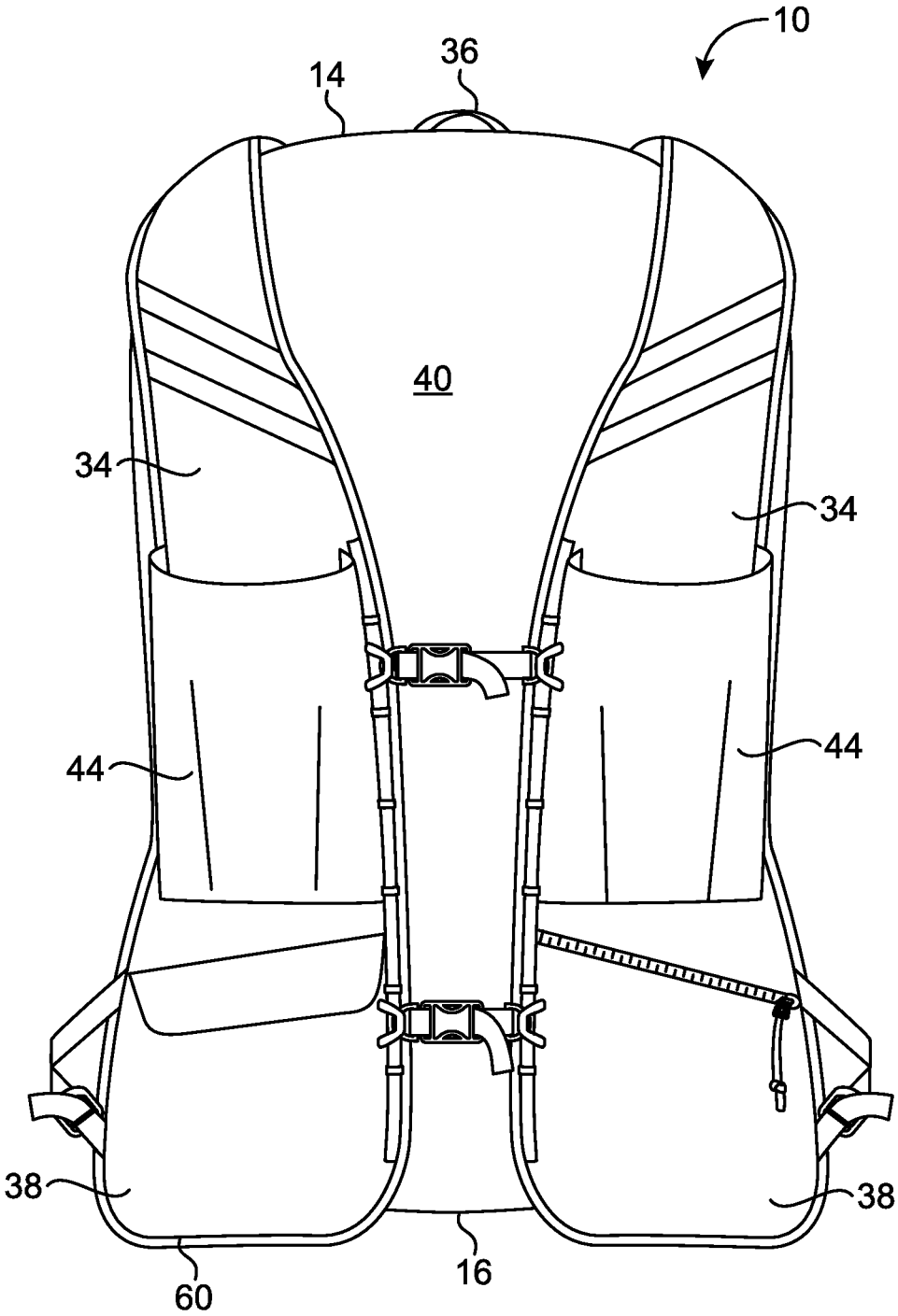
FIG. 4 is a rear elevation of the backpack.
Figure 5:
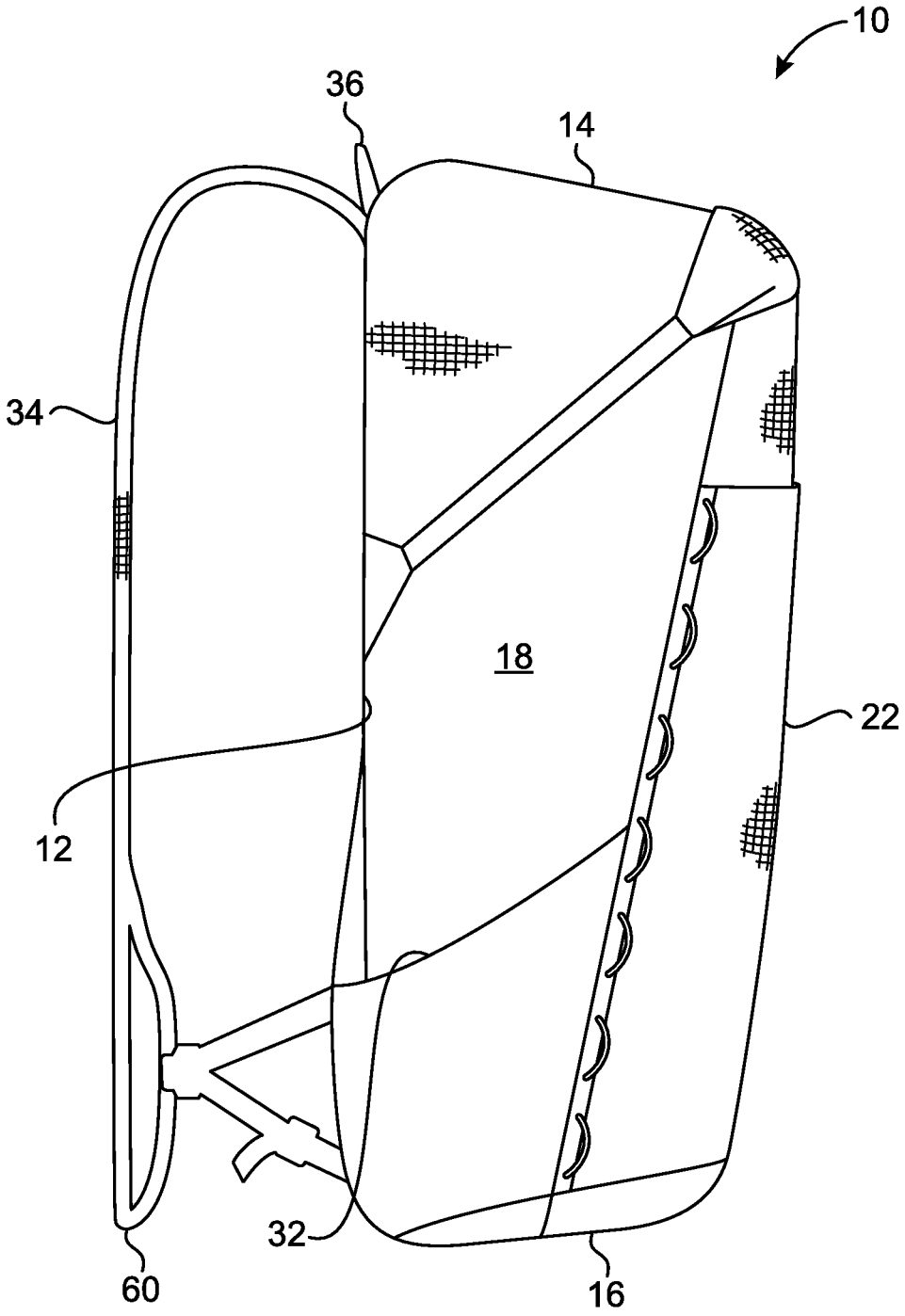
FIG. 5 is a side view of the backpack.

As seen in FIGS. 1-3, each of the side panels 18, 20 include a side pocket 30, 32 for receiving objects (not shown). It is contemplated that the backpack 10 can have more or fewer pockets than illustrated herein. It is also contemplated the pockets 30, 32 of the backpack 10 can be secured or fastened using any suitable fastener, such as, elastomeric bands, slide fasteners, hook and loop, straps, buckles, buttons, and snaps. It is further contemplated that the backpack 10 can include pockets on other panels (for example, the front panel 22).

In one suitable embodiment, the panels 12, 14, 16, 18, 20, and 22 are connected to each other by stitching and are formed from a sufficiently durable and compliant material. The material of the panels 12, 14, 16, 18, 20, and 22 can be any suitable material, including but not limited to, nylon and polyester. Suitably, the material of the panels 16, 18, 20, and 22 is relatively soft, durable, water resistant, odor resistant, and stain resistant.

With reference to FIG. 2, the back panel 12 of the backpack 10 includes a pair of shoulder straps 34 for carrying the backpack 10 on a user's back (not shown). It is contemplated that in other suitable embodiments the backpack 10 can be provided with a single shoulder strap 34 (for example, a sling bag, and a messenger bag). The backpack 10 also includes a handle strap 36 disposed between the back panel 12 and the top panel 14 for manually carrying the backpack 10 with a single hand or for hanging the backpack 10 (for example, on a suitable hook).

In the illustrated embodiment, each of the shoulder straps 34 includes a plurality of pockets 38 for receiving objects (not shown). More specifically, the illustrated backpack 10 has two pockets 44 on each of the shoulder straps 34 but it is understood that the shoulder straps 34 can have any suitable number of pockets or, in other suitable embodiments, be free of pockets. It is also contemplated that the pockets 38 of the shoulder straps 34 can be secured or fastened using any suitable fastener, such as, elastomeric bands, slide fasteners, hook and loop, straps, buckles, buttons, and snaps. As seen in FIG. 2, for example, one of the pockets 38 is selectively closeable using a slide fastener (or zipper) and another using hook and loop.

It is contemplated that the backpack 10 can have any suitable size and shape without departing from some aspects of this invention. In one suitable embodiment, the backpack 10 is configured for allowing the user significant movement (for example, running, jogging, hiking, biking, skiing, climbing) while wearing the backpack 10. In such an embodiment, the backpack 10 is suitably light weight. For example, in one suitable embodiment, the backpack 10 is less than two pounds, more preferably less than one pound, eight ounces, and even more preferably less than one pound.

In one suitable embodiment, the backpack 10 can be configured to receive any suitable hydration container (not shown). For example, the backpack 10 can have one or more exterior water bottle pocket for receive a water bottle (for example, a 20 ounce or 26 ounce bottle with kicker valve available from Ultimate Direction of Boulder, Colo., U.S.A.) and/or an interior reservoir pocket for receiving a reservoir (for example, a 70 ounce or 100 ounce reservoir also available from Ultimate Direction of Boulder, Colo. U.S.A.).

Figure 6:
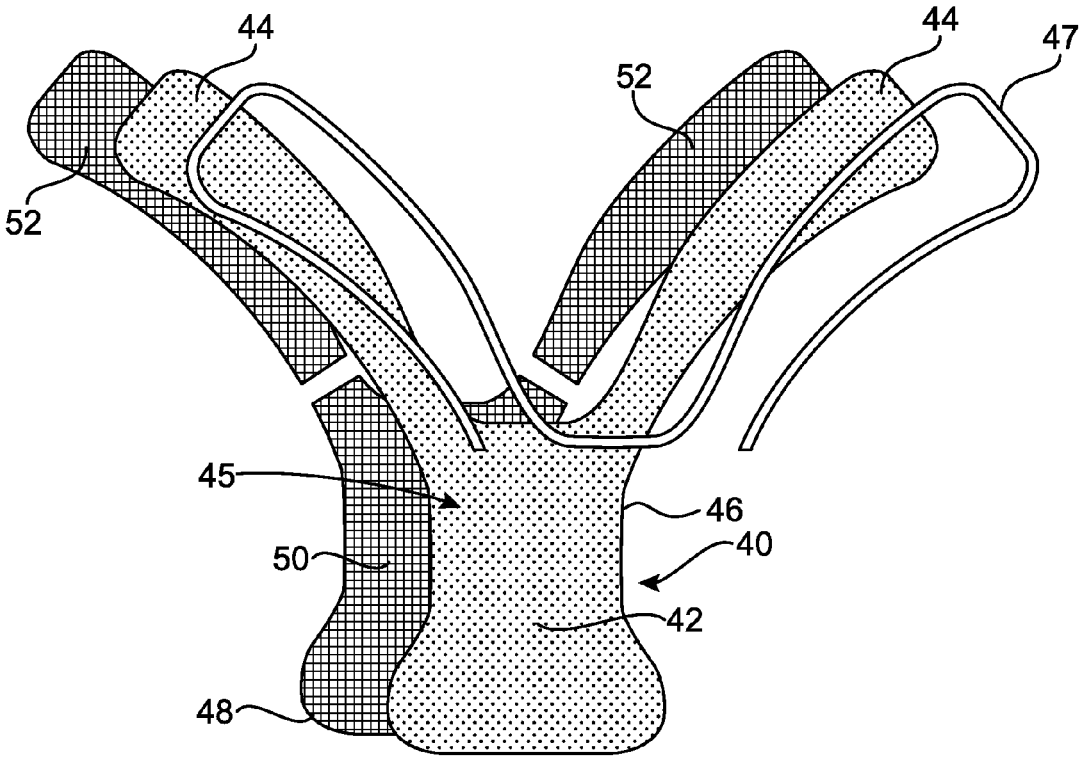
FIG. 6 is a front view of a one-piece, seamless bodyside liner, an insert layer and an edge binding removed from the backpack wherein the bodyside liner, the insert layer, and the edge binding are in a laid flat configuration.

With reference now to FIGS. 2 and 6, the backpack 10 further includes a one-piece, seamless bodyside liner, indicated generally at 40, that lines (or covers) the back panel 12 and/or both of the shoulder straps 34 of the backpack 10. Thus, during use, the seamless bodyside liner 40 is configured for direct face-to-face engagement with the user. Since the bodyside liner 40 is a single-piece of material and does not include any seams, the bodyside liner 40 is less likely to cause skin irritation (such as, but not limited to, chaffing, rashes, and abrasions). More particularly, the seamless bodyside liner 40 of the backpack 10 illustrated and described herein inhibits skin irritation during use of the backpack 10 especially high activity use involving significant movement by the user (for example, running, jogging, hiking, biking, skiing, climbing).

Referring to FIG. 6, the bodyside liner 40 is shown in a laid flat configuration. The bodyside liner 40 includes a body portion 42 for lining the back panel 12 of the backpack 10 and two strap portions 44 for lining each of the shoulder straps 34. As mentioned above, the bodyside liner 40 is a single-piece of material. Thus, the two strap portions 44 of the bodyside liner 40 are integral with the body portion 42. Alternatively, the body portion 42 and the two strap portions 44 may be separately attachable to the bodyside liner 40 and/or the backpack 10. The bodyside liner 40 further includes a peripheral edge 46.

The bodyside liner 40 can be made from any suitable material. Preferably, the bodyside liner 40 is relatively soft, durable, moisture resistant, stain resistant, and odor resistant. In one suitable embodiment, the bodyside liner 40 comprises a suitable mesh material 45 but it is understood that the bodyside liner 40 can include any suitable material without departing from some aspects of this disclosure. For example, one suitable mesh material is available from Duck San Co., LTD of Gyeonggido, South Korea under product number DS14-42.

In the illustrated embodiment, the bodyside liner 40 is attached (for example, by stitching) to the back panel 12 and shoulder straps 34 only along or adjacent the peripheral edge 46. That is, the portions of the bodyside liner 40 inboard of the peripheral edge 46 are free from attachment to the underlying structure (for example, the back panel 12 and shoulder straps 34). As a result, the bodyside liner 40 is free from inboard seams and the only seam associated with the bodyside liner 40 is a peripheral seam attaching the bodyside liner 40 to the underlying structure, for example, the back panel 12 and/or the shoulder straps 34.

In one suitable embodiment, an edge binding 47 is disposed about at least about a portion of the peripheral edge 46 of the bodyside liner 40. In the illustrated embodiment, for example, the edge binding 47 is disposed about the periphery of the strap portions 44 of the bodyside liner 40. As a result, the edge binding 47 trims the attachment of the bodyside liner 40 to the shoulder straps 34. Moreover, the edge binding 47 is disposed about a portion of the body portion 42 of the bodyside liner 40. More particularly, only part of the attachment between the bodyside liner 40 and the back panel 12 is trimmed by the edge binding 47. It is understood, however, edge binding 47 can be used to trim more (including entirely) or less of the peripheral edge 46 of the bodyside liner 40. It is further understood that in some suitable embodiments, the edge binding 47 can be omitted. In such an embodiment, the bodyside liner 40 can have a self-bound seam about the peripheral edge 46.

It is contemplated that the bodyside liner 40 can be attached to the back panel 12 and/or shoulder straps 34 (or other portion(s) of the backpack 10) using any suitable method. That is, the bodyside liner 40 can be attached to the back panel 12 and/or shoulder straps 34 by any means known in the industry that utilizes a suitable mechanical attachment, such as, but not limited to, sewing, bonding, and coupling between two or more fabric layers to permanently bind them together. It is also contemplated that the entire bodyfacing surface of the bodyside liner 40 including along or adjacent the peripheral edge 46 can be seam free. Thus, the portions of the bodyside liner 40 facing the wearer (for example, the bodyfacing surface(s) of the liner 40) can be free from attachment to the underlying structure, such as the back panel 12 and shoulder straps 34. For example, the bodyside liner 40 can be attached to the back panel 12 and/or shoulder straps 34 beyond the bodyfacing surface(s) of the bodyside liner 40 using, for example only, a sew-and-turn (or stitch-and-flip) technique as is known in the industry.

With reference still to FIG. 6, the illustrated embodiment of the backpack 10 further comprises an insert layer 48 underlying at least a portion of the bodyside liner 40. The insert layer 48 is disposed between at least a portion of the bodyside liner 40 and the back panel 12 and/or the shoulder straps 34. As seen in FIG. 6, the illustrated insert layer 48 comprises a body portion 50 and a pair of strap portions 52 separate from the body portion 50. Alternatively, the pair of strap portions 52 can be integrated with the body portion 50. The body portion 50 of the insert layer 48 underlies the body portion 42 of the bodyside liner 40, and the strap portions 52 of the insert layer underlie the strap portions 44 of the bodyside liner 40. It is contemplated that the insert layer 48 can be formed from a single-piece of material or a plurality of separate, discrete pieces. The insert layer 48 facilitates attaching the bodyside liner 40 to the backpack 10.

Moreover, the insert layer 48 can be formed from any suitable material or combination of suitable materials. Preferably, the insert layer 48 is relatively soft, durable, moisture resistant, stain resistant, and odor resistant. In one suitable embodiment, at least a portion of the insert layer 48 comprises a suitable mesh material. In the illustrated embodiment, for example, the entire insert liner 48 is formed by the mesh material. In another suitable embodiment, at least a portion of the insert layer 48 comprises a suitable padding material (for example, ethylene vinyl acetate (or EVA) padding). In an embodiment, the body portion 42 of the bodyside liner 40 comprises a suitable mesh material, and the strap portions 52 of the insert layer 48 comprise a suitable padding material. In other suitable embodiments, the insert layer 48 can be, in whole or in part, any suitable foam, sponge, or other padding material including but not limited to EVA, PU, PE, designed to provide structure, support, pressure distribution and/or cushioning at the interface between the backpack 10 and the wearer. In another suitable embodiment, the insert layer 48 can be any fabric, flexible molded plastic or composite, or other manufactured structure which is able to conform on a majority but limited basis to the wearer's body in such manner that areas where the insert layer 48 does not conform such non-conforming portion is designed to enhance breathability and air flow between the user and the backpack 10. It is also contemplated that is other suitable embodiments, the insert layer 48 can be eliminated or have any suitable configuration without departing from some aspects of this disclosure.

Figure 7:
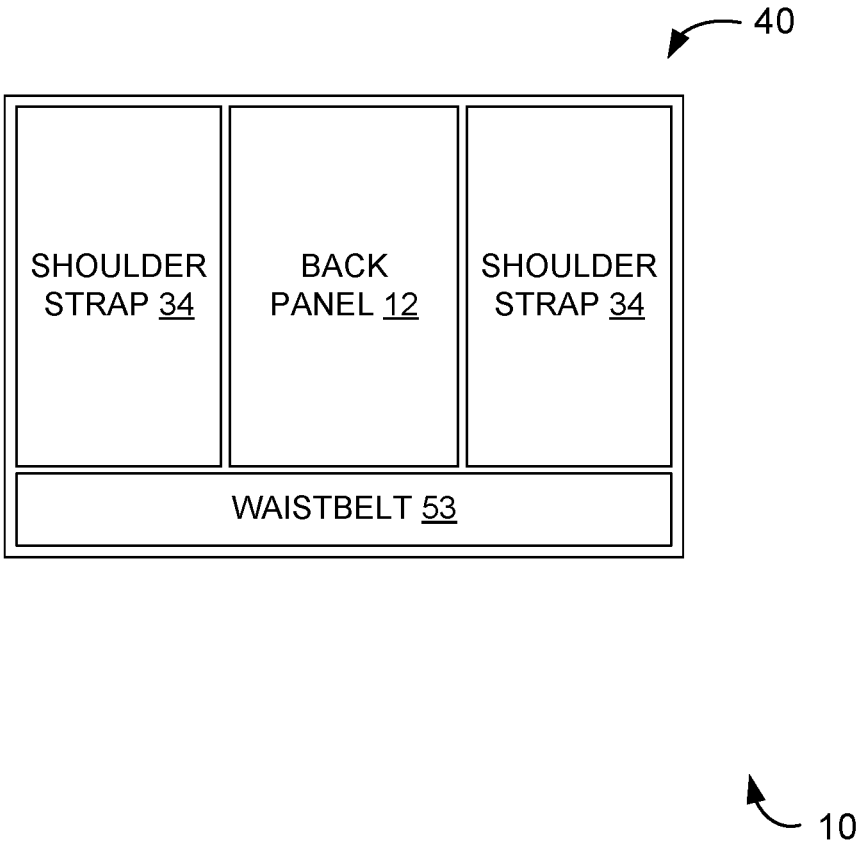
FIG. 7 is a schematic view of the backpack of FIG. 1 with the bodyside liner of FIG. 6.

As shown in FIG. 7, it is contemplated that the backpack 10 illustrated in FIGS. 1-6 can include a waistbelt 53 for releasably securing the backpack 10 around the user's waist. In one suitable embodiment, the waistbelt 53 is selectively adjustable such that the backpack 10 can be form fitted to the user's waist when the backpack 10 is worn. In one embodiment of the backpack 10 having a waist belt 53, the bodyside liner 40 can be configured to cover the body-facing portions of the waist belt 53. Thus, in such an embodiment, the one-piece seamless bodyside liner 40 lines (or covers) the back panel 12, both of the shoulder straps 34, and the waist belt 53.

Figure 8:
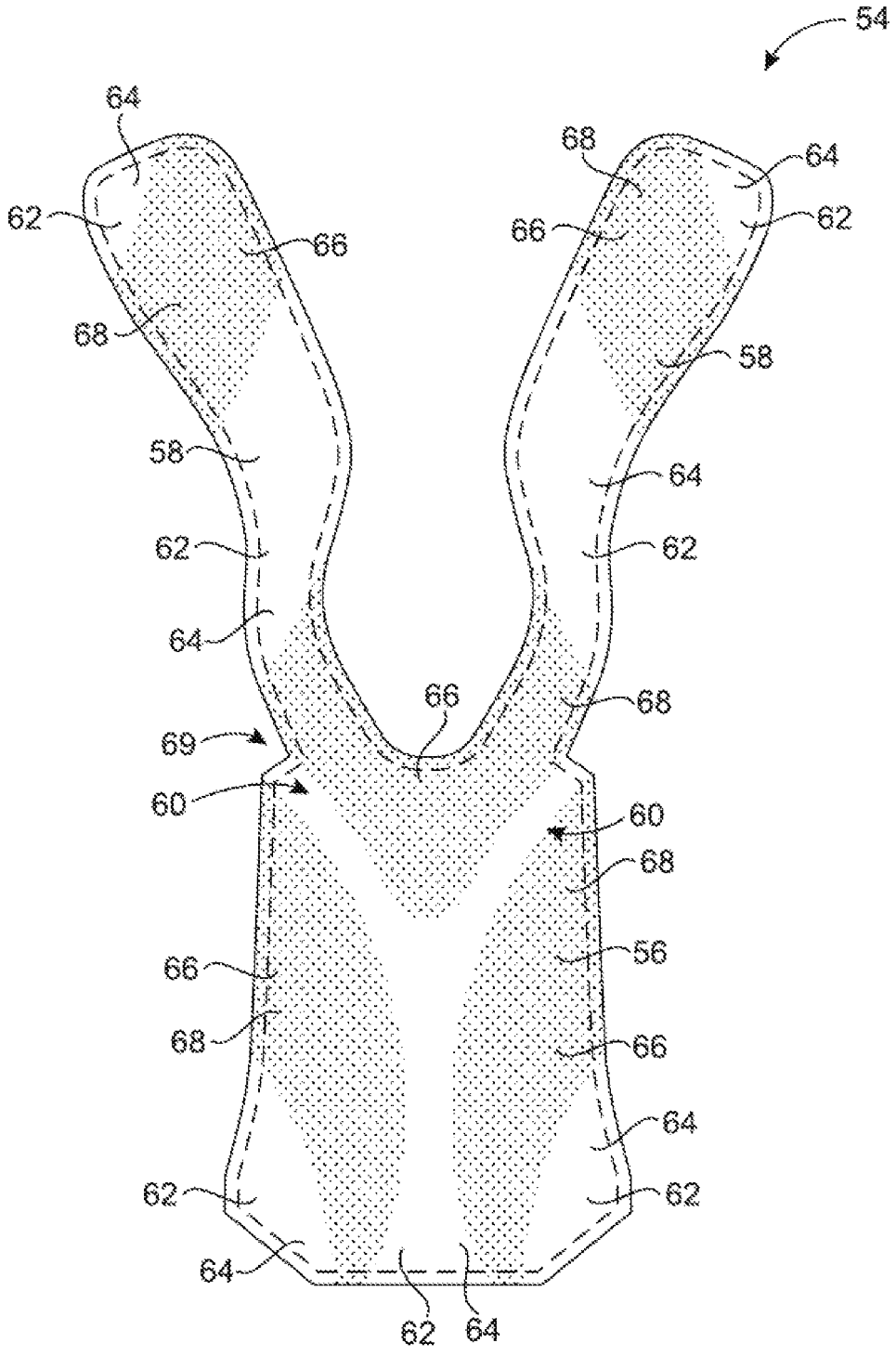
FIG. 8 is a front view of one another suitable embodiment of a bodyside liner for the use with the backpack of FIG. 1 wherein the bodyside liner is in a laid flat configuration.
Figure 9:
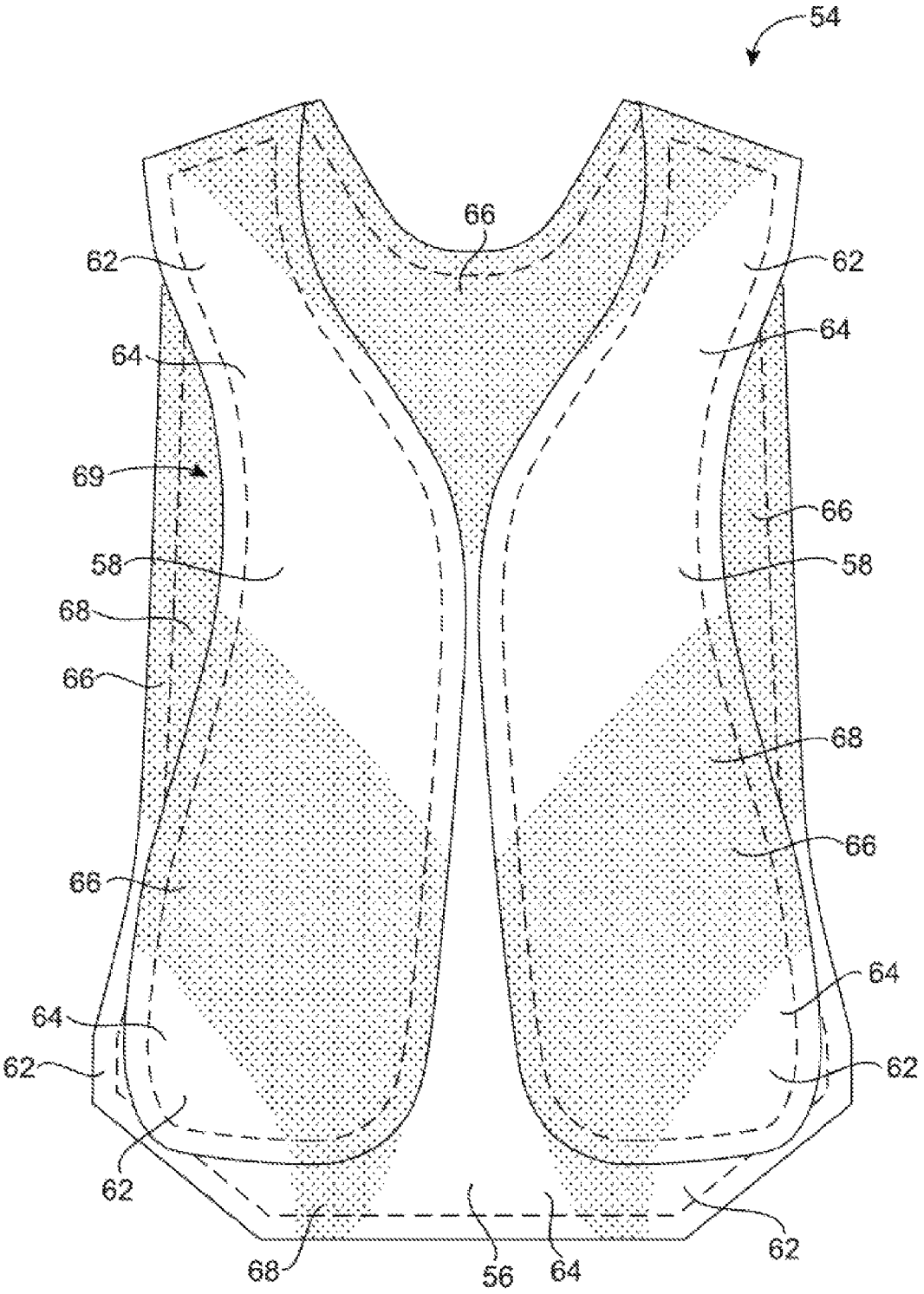
FIG. 9 is a front view of the bodyside liner of FIG. 8 in a folded configuration.
Figure 10:
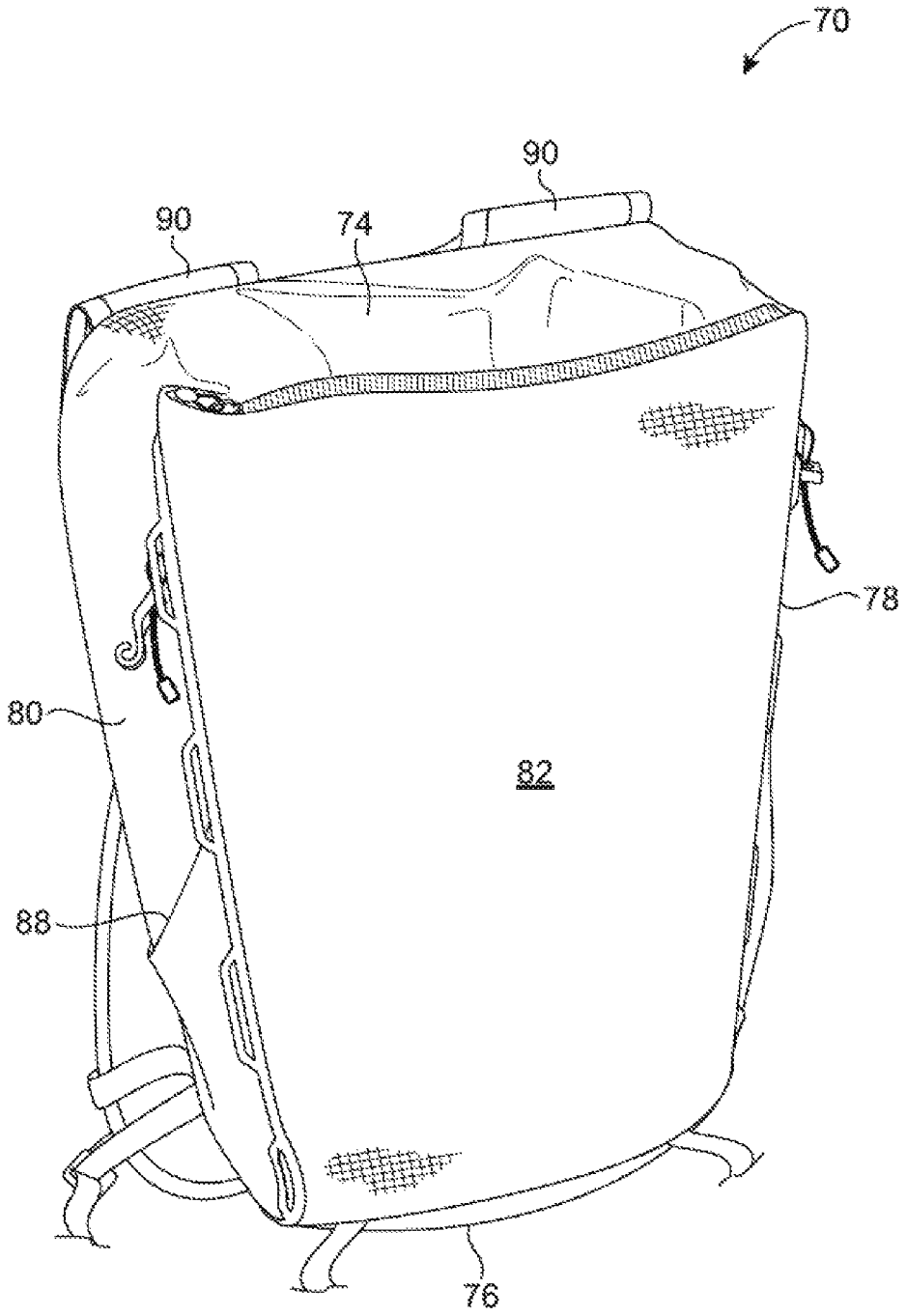
FIG. 10 is a front perspective of another suitable embodiment of a backpack of the present disclosure.

FIGS. 8 and 9 illustrate another suitable embodiment of a one-piece, seamless bodyside liner, indicated generally at 54 that is suitable for use with the backpack 10 seen in FIGS. 1-5. FIG. 8 illustrates the bodyside liner 54 in laid flat condition and FIG. 9 illustrates the bodyside liner 54 is a folded (or use) condition. The bodyside liner 54 is configured to line (or cover) the back panel 12 and/or both of the shoulder straps 34 of the backpack 10. Thus, during use, the seamless bodyside liner 54 is configured for direct face-to-face engagement with the user. Since the bodyside liner 54 is a single-piece of material and does not include any seams, the bodyside liner 54 is less likely to cause skin irritation (for example, chaffing, rashes, and abrasions) during use of the backpack 10.

As seen in FIGS. 8 and 9, the bodyside liner 54 includes a body portion 56 for lining the back panel 12 of the backpack 10 and two strap portions 58 for lining each of the shoulder straps 34. As mentioned above, the bodyside liner 54 is a single-piece of material. Thus, the two strap portions 58 of the bodyside liner 54 are integral with the body portion 56. Alternatively, the body portion 56 and the two strap portions 58 may be separately attachable to the bodyside liner 54 and/or the backpack 10.

The bodyside liner 54 can be made from any suitable material. Preferably, the bodyside liner 54 is relatively soft, durable, moisture resistant, stain resistant, and odor resistant. In one suitable embodiment, the bodyside liner 54 includes a suitable mesh material 60 but it is understood that the bodyside liner 54 can include any suitable material without departing from some aspects of this disclosure. In this embodiment, the mesh material 60 includes a plurality of first areas 62 of mesh having a first weave configuration 64, and a plurality of second areas 66 of mesh having a second weave configuration 68 that is different than the first weave configuration 64. In the illustrated embodiment, the first areas 62 having the first weave configuration 64 includes a tight weave; and, the second areas 66 having the second weave configuration 68 includes a medium weave. Alternatively, the first weave configuration 64 may include a medium weave or a low/loose weave. Moreover, the second weave configuration 68 may include a tight weave or a low/loose weave. It is understood that the first and second areas 62, 66 of the bodyside liner 54 can have other characteristics that are different instead of or in addition to the weave. The first areas 62 and second areas 66 are configured to facilitate providing characteristics such as, but not limited to, comfort, durability, moisture resistance, odor resistance, and stein resistance for the bodyside liner 54.

In the exemplary embodiment, the first areas 62 and the second areas 66 are configured in a sequential pattern 69 along the bodyside liner 54. In an embodiment, the first areas 62 and the second areas 66 are configured in an alternating pattern with respect to each other. In one embodiment, the first areas 62 include a Y-shape applied to the body portion 56. Alternatively, the first areas 62 and the second areas 66 can include any pattern. Moreover, the first areas 62 and the second areas 66 are configured to include a plurality of variety of shapes and sizes.

In the exemplary embodiment, the bodyside liner 54 may include the peripheral edge 46 and/or the edge binding 47 (shown in FIG. 6). The bodyside liner 54 can be attached to the back panel 12 and/or shoulder straps 34 (or other portions of the backpack 10) using any suitable method. Moreover, the insert layer 48 (shown in FIG. 6) may be used with the bodyside liner 54.

FIGS. 10-15 illustrate another suitable embodiment of a backpack, indicated generally at 70, of the present disclosure. The backpack 70 includes a back panel 72, a top panel 74, a bottom panel 76, two side panels (for example, a right side panel 78 and a left side panel 80 as viewed in FIG. 10), and a front panel 82. The panels 70, 72, 74, 76, 78, 80, and 82 cooperatively define at least one interior compartment (not shown) adapted to store objects for transport in the backpack 70. In the illustrated embodiment, the interior compartment can be accessed by moving the top panel 74 from a closed position (FIGS. 10-15) to an opened position (not shown). The top panel 74 can be secured in the closed position using any suitable fastening system comprising one or more suitable fasteners. It is understood that the any suitable fasteners (for example, buckles, a slide fastener, straps, hook and loop, snaps, buttons) can be used to secure the top panel 74 in the closed position. It is also understood that the interior compartment can be accessed in a different matter (for example, using a slide fastener to separate one or more of the panels 70, 72, 74, 76, 78, 80, and 82) without departing from some aspects of this disclosure.

Figure 11:
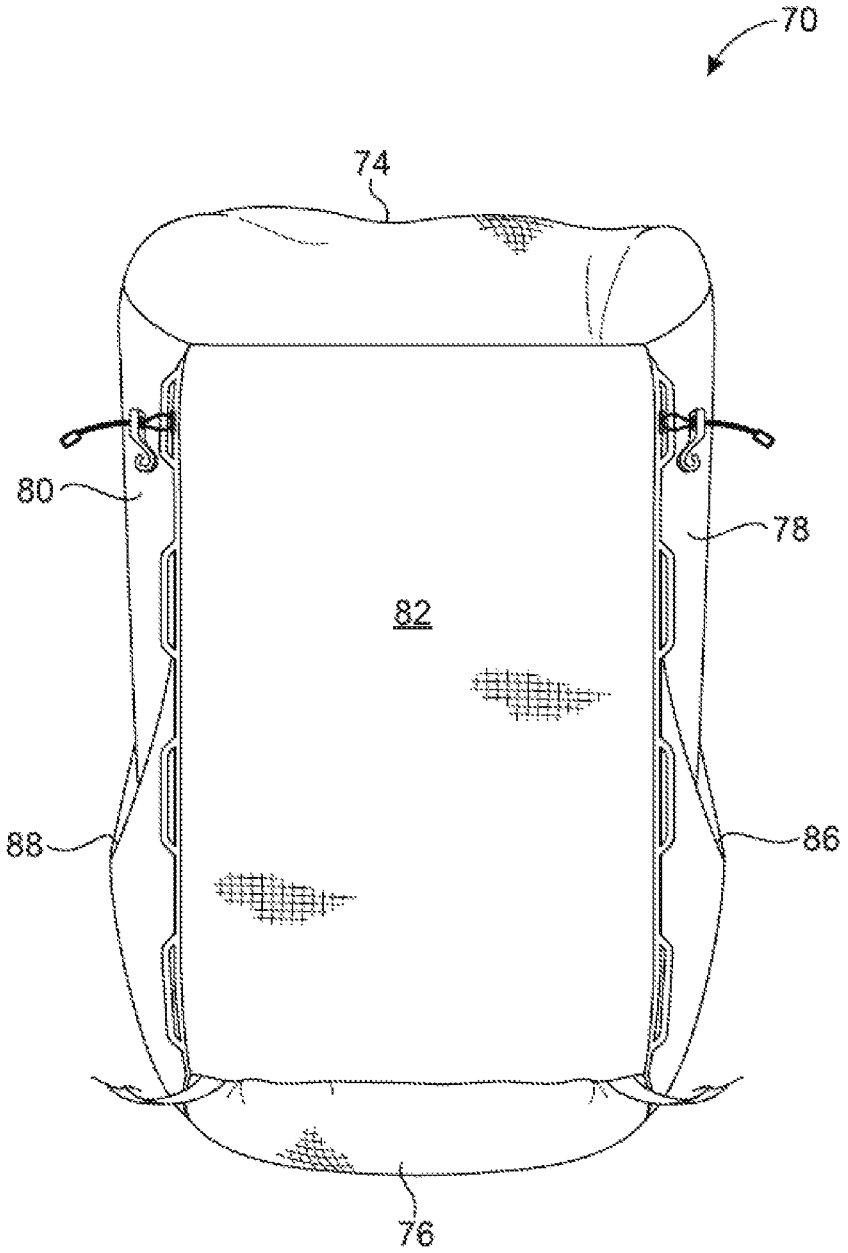
FIG. 11 is a front elevation of the backpack.
Figure 12:
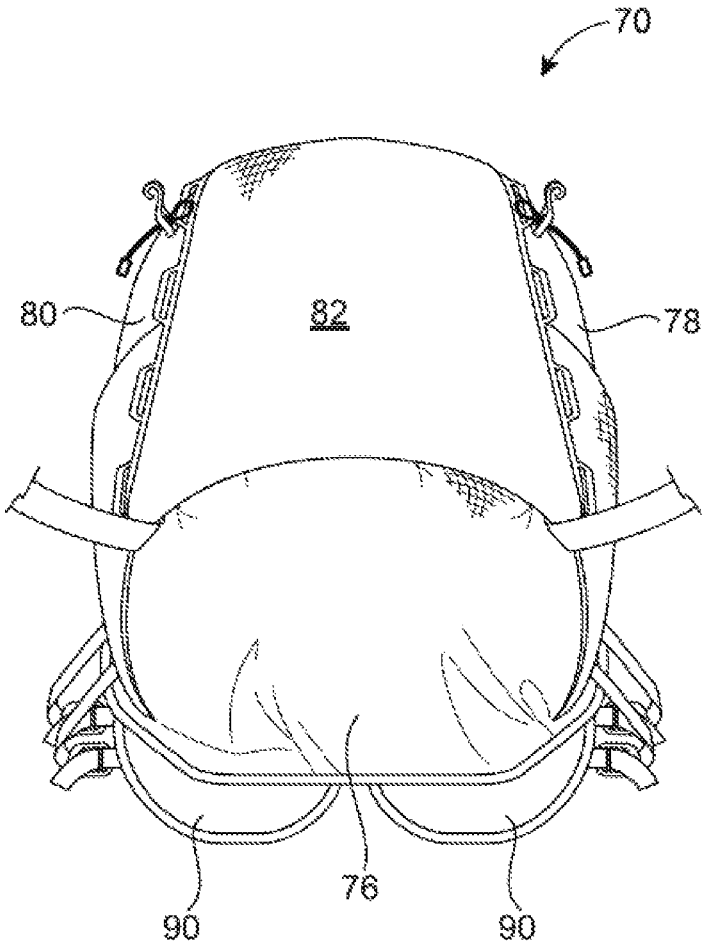
FIG. 12 is a bottom view of the backpack.
Figure 13:
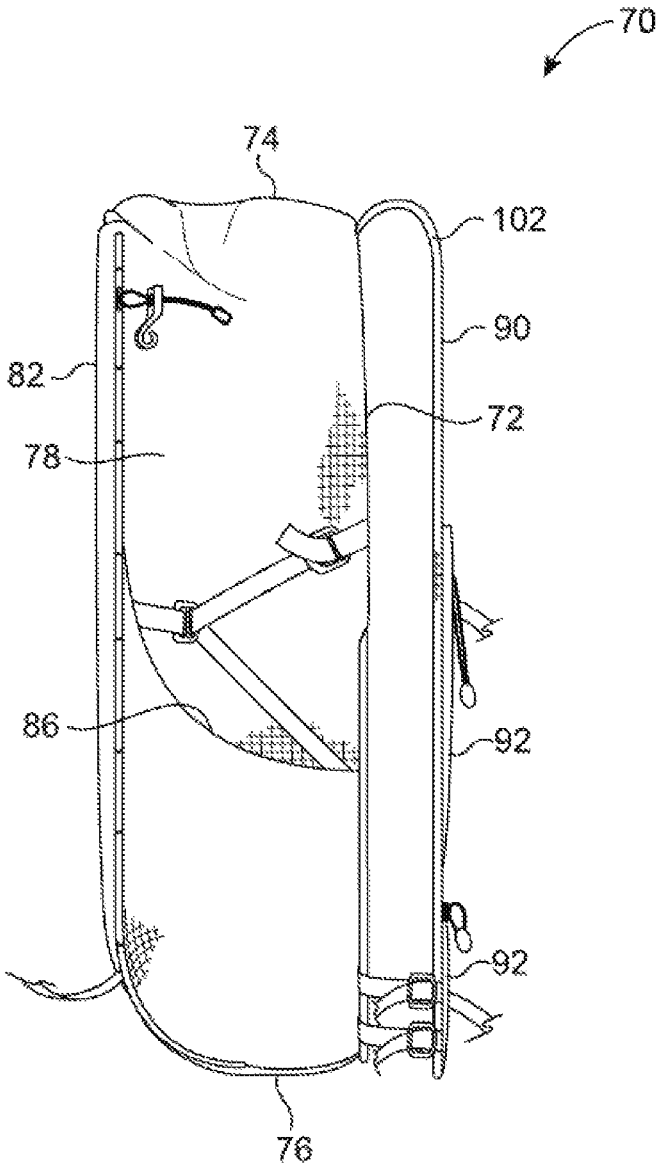
FIG. 13 is a side view of the backpack.

As seen in FIGS. 11 and 13, each of the side panels 78, 80 include a side pocket 86, 88 for receiving objects (not shown). It is contemplated that the backpack 70 can have more or fewer pockets than illustrated herein. It is also contemplated the pockets 86, 88 of the backpack 70 can be secured or fastened using any suitable fastener, such as, elastomeric bands, slide fasteners, hook and loop, straps, buckles, buttons, and snaps. It is further contemplated that the backpack 70 can include pockets on other panels (for example, the front panel 82).

In one suitable embodiment, the panels 70, 72, 74, 76, 78, 80, and 82 are connected to each other by stitching and are formed from a sufficiently durable and compliant material. The material of the panels 70, 72, 74, 76, 78, 80, and 82 can be any suitable material, including but not limited to, nylon and polyester. The illustrated panels 70, 72, 74, 76, 78, 80, and 82, for example, are made of nylon. Suitably, the material of the panels 70, 72, 74, 76, 78, 80, and 82 is relatively soft, durable, water resistant, odor resistant, and stain resistant.

Figure 14:
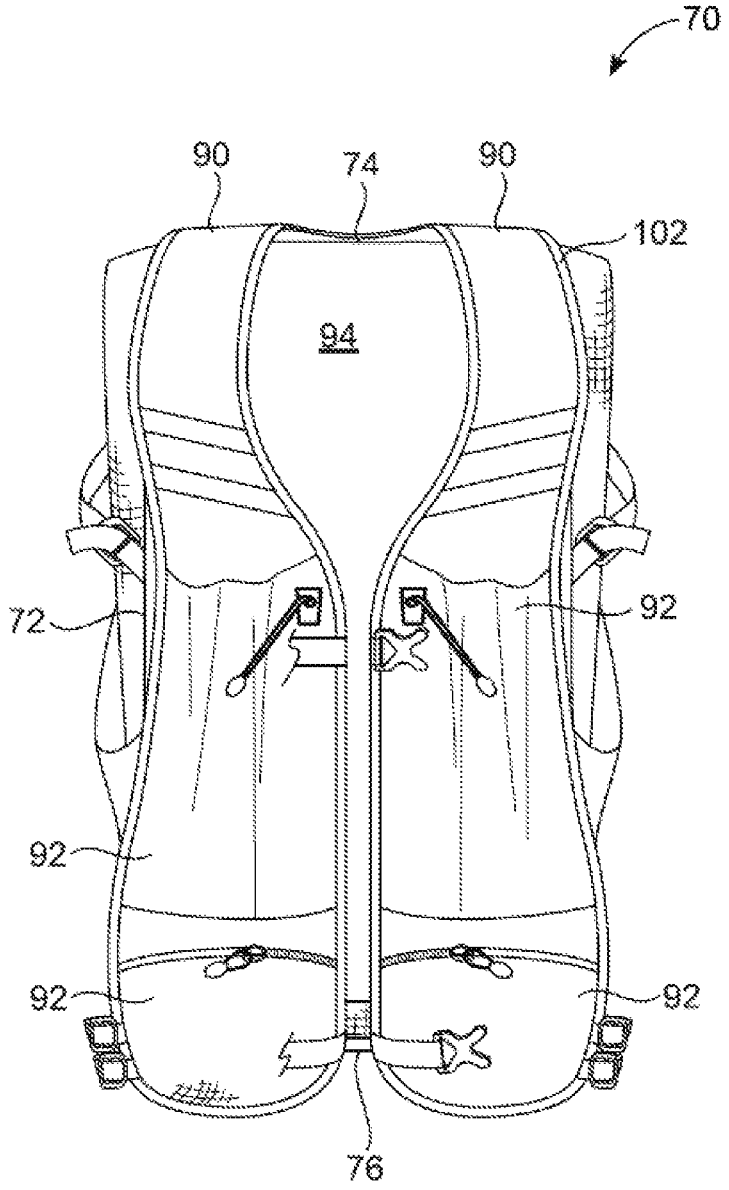
FIG. 14 is a rear elevation of the backpack.

With reference to FIG. 14, the back panel 72 of the backpack 70 includes a pair of shoulder straps 90 for carrying the backpack 70 on a user's back. It is contemplated that in other suitable embodiments the backpack 70 can be provided with a single shoulder strap 90 (for example, a sling bag). In the illustrated embodiment, each of the shoulder straps 90 includes a plurality of pockets 92 for receiving objects (not shown). More specifically, the illustrated backpack 70 has two pockets 92 on each of the shoulder straps 90 but it is understood that the shoulder straps 90 can have any suitable number of pockets or, in other suitable embodiments, be free of pockets. It is also contemplated the pockets 92 of the shoulder straps 90 can be secured or fastened using any suitable fastener, such as, elastomeric bands, slide fasteners, hook and loop, straps, buckles, buttons, and snaps. As seen in FIG. 14, for example, one of the pockets 92 is selectively closeable using a slide fastener (or zipper) and another using hook and loop.

It is contemplated that the backpack 70 can have any suitable size and shape without departing from some aspects of this invention. In one suitable embodiment, the backpack 70 is configured for allowing the user significant movement (e.g., running, jogging, hiking, biking, skiing) while wearing the backpack 70. In such an embodiment, the backpack 70 is suitably light weight. For example, in one suitable embodiment, the backpack 70 is less than two pounds, more preferably less than one pound, eight ounces, and even more preferably less than one pound.

In one suitable embodiment, the backpack 70 can be configured to receive any suitable hydration container (not shown). For example, the backpack can have one or more exterior water bottle pocket for receive a water bottle (for example, a 20 ounce or 26 ounce bottle with kicker valve available from Ultimate Direction of Boulder, Colo., U.S.A.) and/or an interior reservoir pocket for receiving a reservoir (e.g., a 70 ounce or 100 ounce reservoir also available from Ultimate Direction of Boulder, Colo. U.S.A.).

Figure 15:
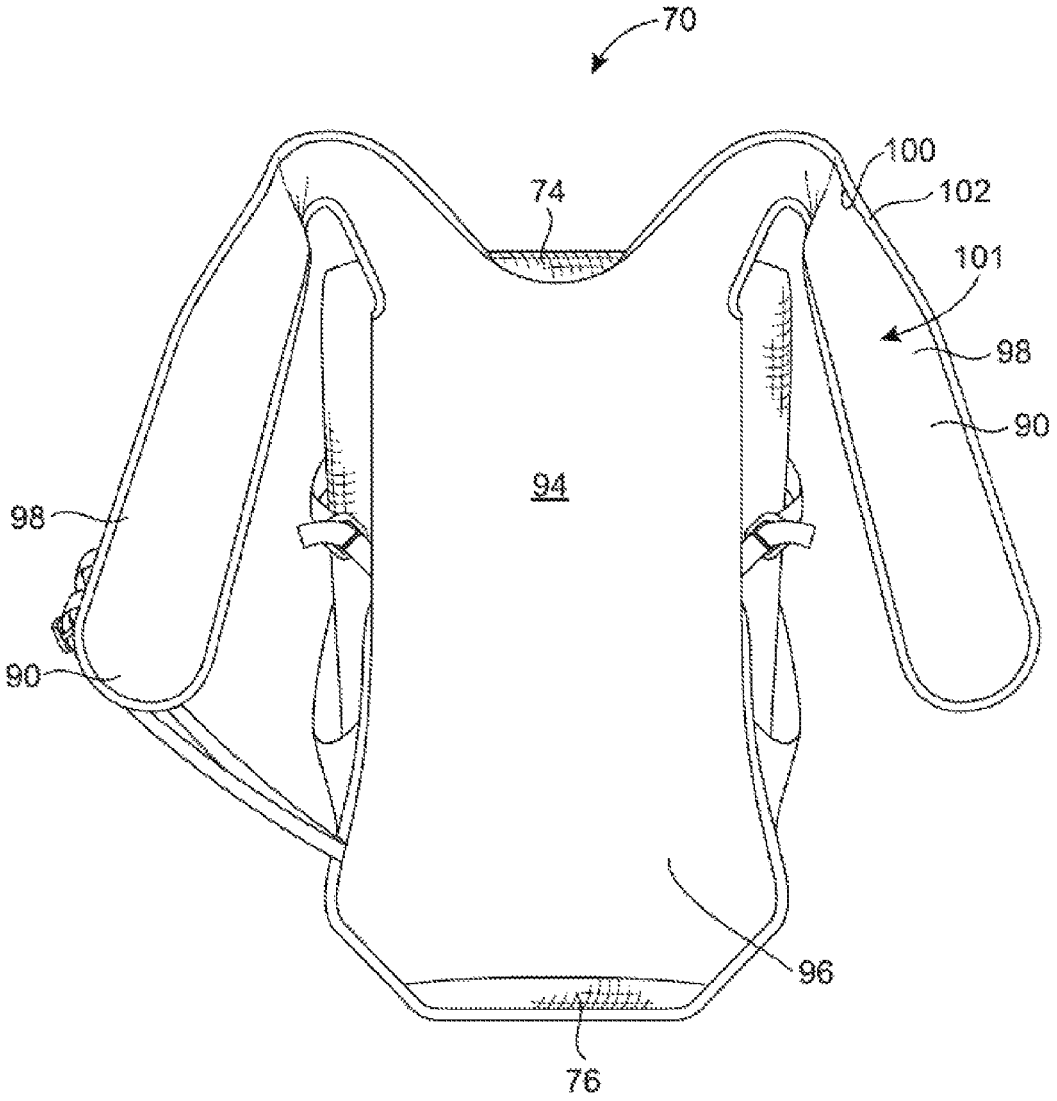
FIG. 15 is a rear elevation of the backpack with shoulder straps of the backpack folded outward to show a bodyside liner of the backpack.

With reference now to FIGS. 14 and 15, the backpack 70 further includes a one-piece, seamless bodyside liner, indicated generally at 94, that lines (or covers) the back panel 72 and/or both of the shoulder straps 90 of the backpack 70. Thus, during use, the seamless bodyside liner 94 is configured for direct face-to-face engagement with the user. Since the bodyside liner 94 is a single-piece of material and does not include any seams, the bodyside liner 94 is less likely to cause skin irritation (for example, chaffing, rashes, and abrasions). In other words, the backpack 70 illustrated and described herein inhibits skin irritation during use of the backpack 70 especially high activity use involving significant movement by the user (e.g., running, jogging, hiking, biking, skiing).

The bodyside liner 94 includes a body portion 96 for lining the back panel 72 of the backpack 70 and two strap portions 98 for lining each of the shoulder straps 90. As mentioned above, the bodyside liner 94 is a single-piece of material. Thus, the two strap portions 98 of the bodyside liner 94 are integral with the body portion 96. Alternatively, the body portion 96 and the strap portions 98 may be separately attachable to the bodyside liner 94 and/or the backpack 70. The bodyside liner 94 further includes a peripheral edge 100.

The bodyside liner 94 can be made from any suitable material. Preferably, the bodyside liner 94 is relatively soft, durable, moisture resistant, stain resistant, and odor resistant. In one suitable embodiment, the bodyside liner 94 comprises a suitable mesh material 101 but it is understood that the bodyside liner 94 can comprise any suitable material without departing from some aspects of this disclosure. For example, one suitable mesh material 101 is available from Duck San Co., LTD of Gyeonggido, South Korea under product number DS14-42.

In the illustrated embodiment, the bodyside liner 94 is attached (for example, by stitching) to the back panel 72 and shoulder straps 90 only along or adjacent the peripheral edge 100 (FIGS. 14 and 15). That is, the portions of the bodyside liner 94 inboard of the peripheral edge 100 are free from attachment to the underlying structure (for example, the back panel 72 and shoulder straps 90). As a result, the bodyside liner 94 is free from inboard seams and the only seam associated with the bodyside liner 94 is the peripheral seam attaching it to the underlying structure, for example the back panel 72 and/or the shoulder straps 90.

In one suitable embodiment, an edge binding 102 is disposed about at least about a portion of the peripheral edge 100 of the bodyside liner 94. In the illustrated embodiment, for example, the edge binding 102 is disposed about the periphery of the strap portions 98 of the bodyside liner 94. As a result, the edge binding 102 trims the attachment of the bodyside liner 94 to the shoulder straps 90. Moreover, the edge binding 102 is disposed about a portion of the body portion 96 of the bodyside liner 94. More particularly, only part of the attachment between the bodyside liner 94 and the back panel 72 is trimmed by the edge binding 102. It is understood, however, edge binding 102 can be used to trim more (including entirely) or less of the periphery of the bodyside liner 94. It is further understood that in some suitable embodiments, the edge binding 102 can be omitted. In such an embodiment, the bodyside liner 94 can have a self-bound seam about the peripheral edge 100. In an embodiment, the insert layer 48 (shown in FIG. 6) may be used with the bodyside liner 94.

Figure 16:
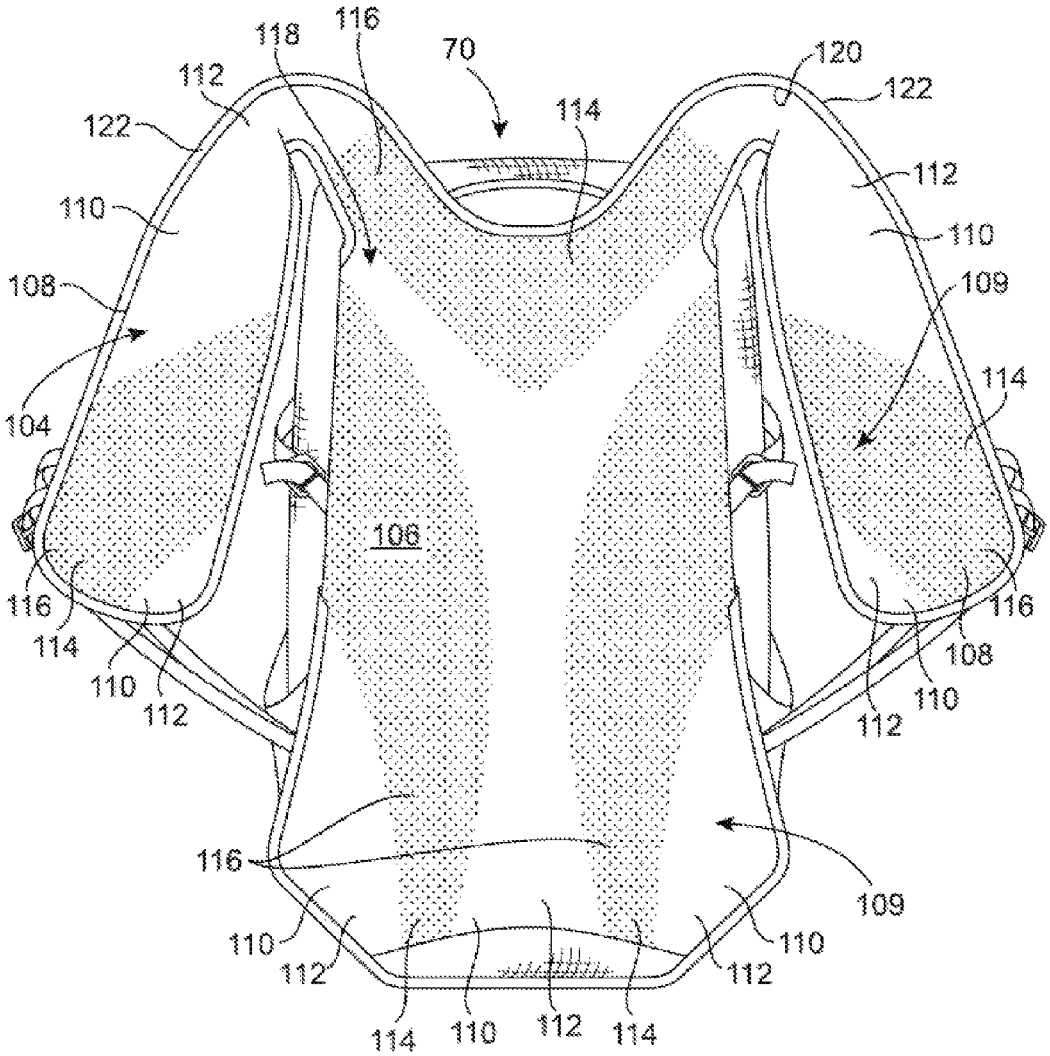
FIG. 16 is a rear elevation similar to FIG. 15 but showing another suitable embodiment of the backpack of the present disclosure having a one-piece, seamless bodyside liner.
Figure 17:
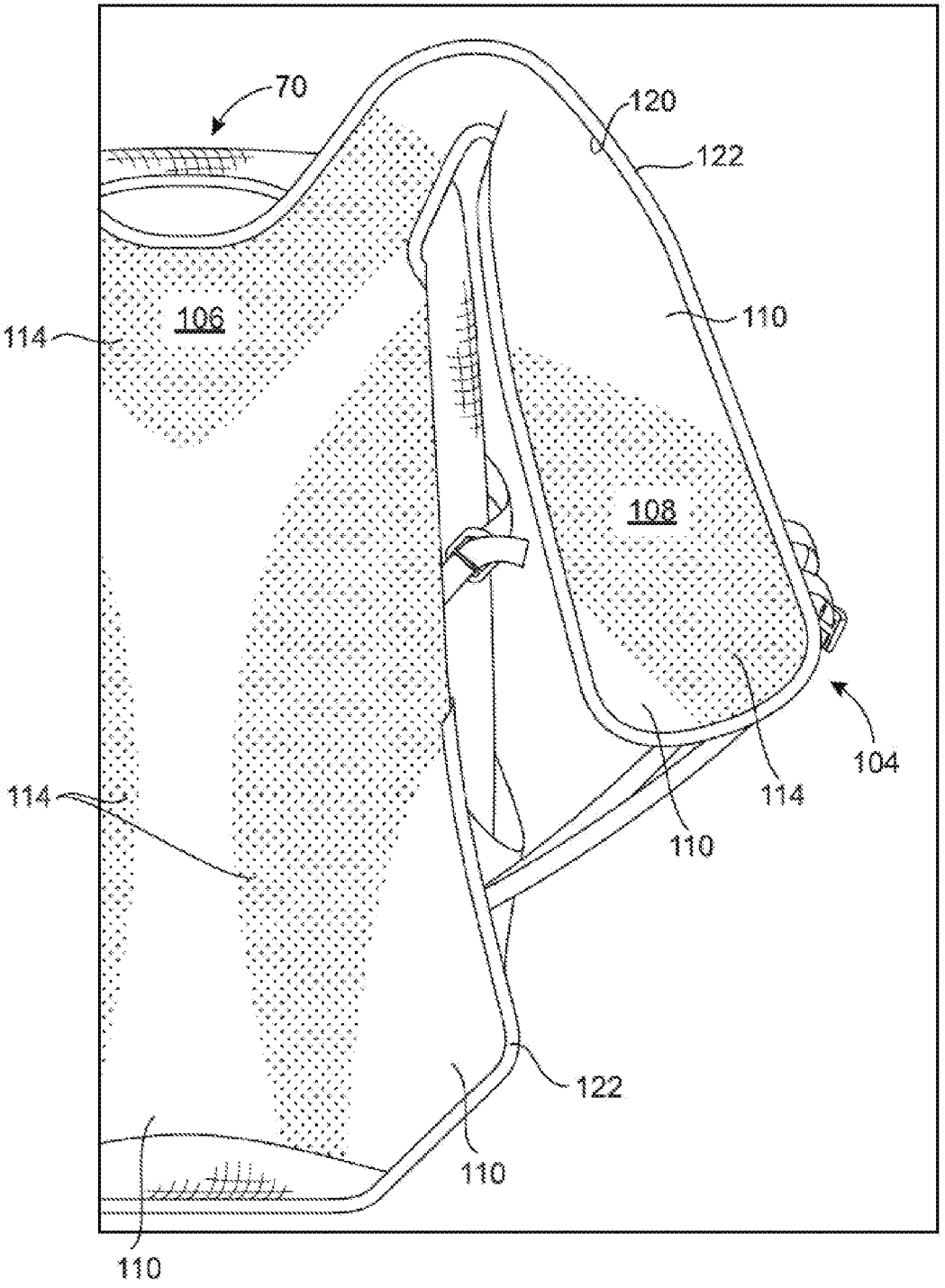
FIGS. 17 and 18 are enlarged rear elevations of the backpack of FIG. 16 showing the bodyside liner.
Figure 18:
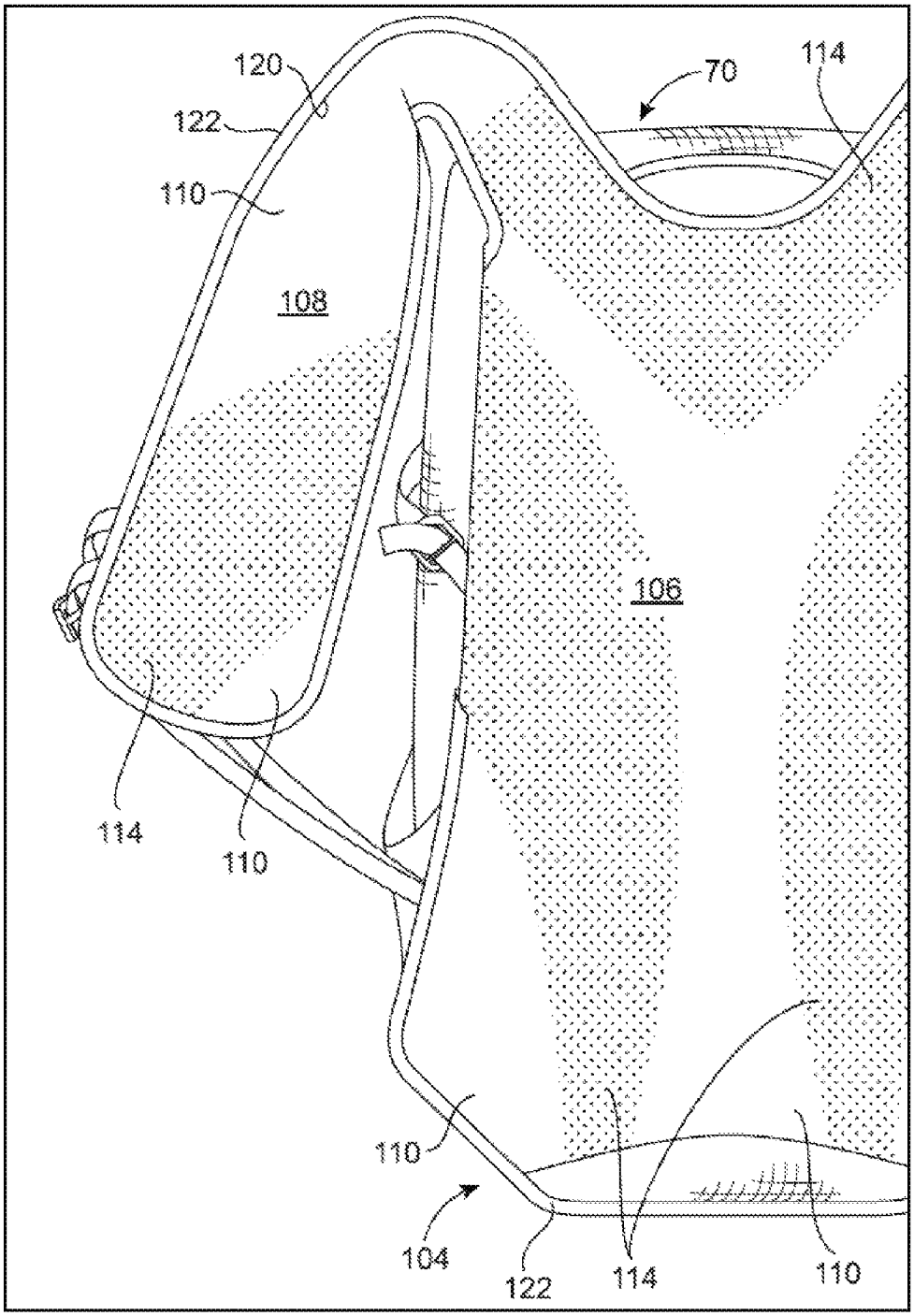

FIGS. 16-18 illustrate another suitable embodiment of a one-piece, seamless bodyside liner, indicated generally at 104 that is suitable for use with the backpack 70 seen in FIGS. 10-15. Alternatively, the bodyside liner 104 may be suitable for any type of backpack such as, for example, only, backpack 10 (shown in FIGS. 1-6). The bodyside liner 104 is configured to line (or cover) the back panel 72 and/or both of the shoulder straps 90 of the backpack 70. Thus, during use, the seamless bodyside liner 104 is configured for direct face-to-face engagement with the user. Since the bodyside liner 104 is a single-piece of material and does not include any seams, the bodyside liner is less likely to cause skin irritation (for example, chaffing, rashes, and abrasions) during use of the backpack 70.

As seen in FIGS. 16-18, the bodyside liner 104 includes a body portion 106 for lining the back panel 72 of the backpack 70 and two strap portions 108 for lining each of the shoulder straps 90. As mentioned above, the bodyside liner 94 is a single-piece of material. Thus, the two strap portions 108 of the bodyside liner 104 are integral with the body portion 106. Alternatively, the body portion 106 and the strap portions 108 may be separately attachable to the bodyside liner 104 and/or the backpack 70.

The bodyside liner 104 can be made from any suitable material. Preferably, the bodyside liner 104 is relatively soft, durable, moisture resistant, stain resistant, and odor resistant. In one suitable embodiment, the bodyside liner 104 comprises a suitable mesh material 109 but it is understood that the bodyside liner 104 can comprise any suitable material without departing from some aspects of this disclosure. In this embodiment, the mesh material 109 comprises a plurality of first areas 110 of mesh having a first weave configuration 112, and a plurality of second areas 358 of mesh having a second weave configuration 116 that is different than the first weave configuration 112. In the illustrated embodiment, the first areas 110 having the first weave configuration 112 includes a tight weave and the second areas 114 having the second weave configuration 116 includes a medium weave. Alternatively, the first weave configuration 112 may include a medium weave or a low/loose weave. Moreover, the second weave configuration 116 may include a tight weave or a low/loose weave. It is understood that the first and second areas 110, 114 of the bodyside liner 104 can have other characteristics that are different instead of or in addition to the weave. The first areas 110 and the second areas 114 are configured to facilitate providing characteristics such as, but not limited to, comfort, durability, moisture resistance, odor resistance, and stain resistance for the bodyside liner 104.

In the exemplary embodiment, the first areas 110 and the second areas 114 are configured in a sequential pattern 118 along the bodyside liner. In an embodiment, the first areas 110 and the second areas 114 are configured in an alternating pattern with respect to each other. Moreover, the first areas 110 and the second areas 114 are configured to include a plurality of variety of shapes and sizes. In one embodiment, the first areas 355 include a Y-shape applied to the body portion 106.

In the illustrated embodiment, the bodyside liner 104 is attached (for example, by stitching) to the back panel 72 and shoulder straps 90 only along or adjacent a peripheral edge 120. That is, the portions of the bodyside liner 104 inboard of the peripheral edge 120 are free from attachment to the underlying structure (for example, the back panel 72 and shoulder straps 90). As a result, the bodyside liner 104 is free from inboard seams and the only seam associated with the bodyside liner 104 is the peripheral seam attaching it to the underlying structure, for example the back panel 72 and/or the shoulder straps 90.

In one suitable embodiment, an edge binding 122 is disposed about at least about a portion of the peripheral edge 120 of the bodyside liner 104. In the illustrated embodiment, for example, the edge binding 122 is disposed about the periphery of the strap portions 108 of the bodyside liner 104. As a result, the edge binding 122 trims the attachment of the bodyside liner 104 to the shoulder straps 90. Moreover, the edge binding 122 is disposed about a portion of the body portion 106 of the bodyside liner 104. More particularly, only part of the attachment between the bodyside liner 104 and the back panel 72 is trimmed by the edge binding 122. It is understood, however, edge binding 122 can be used to trim more (including entirely) or less of the periphery of the bodyside liner 104. It is further understood that in some suitable embodiments, the edge binding 122 can be omitted. In such an embodiment, the bodyside liner 104 can have a self-bound seam about the peripheral edge 120. Moreover, the insert layer 48 (shown in FIG. 6) may be used with the bodyside liner 104.

It is contemplated that the one-piece seamless bodyside liners 40, 54, 94, and 104 disclosed herein can be adapted for packs other than backpacks without departing from some aspects of this disclosure. For example, the one-piece seamless bodyside liners 0, 54, 94, and 104 can be adapted for hip packs, waist packs, fanny packs wherein the bodyside liner fully covers the body-facing portions of the respective pack.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages language of the claims.

What is claimed is:

1. A backpack comprising:

at least one panel defining an interior compartment adapted to store objects for transport in the backpack, the at least one panel having a bodyfacing surface;

a pair of shoulder straps attached to the at least one panel for use in carrying the backpack on a user's back, each of the shoulder straps having another bodyfacing surface; and a bodyside liner covering the bodyfacing surfaces of the at least one panel and the pair of shoulder straps, the bodyside liner being free from attachment to the at least one panel and the shoulder straps except along a peripheral edge of the bodyside liner such that the bodyside liner is free from one or more inboard seams, the peripheral edge of the bodyside liner being attached to the at least one panel and the pair of the shoulder straps.

2. The backpack set forth in claim 1, wherein the at least one panel comprises a plurality of panels including a back panel, a top panel, a bottom panel, two side panels, and a front panel, each of the plurality of panels defining at least a portion of the interior compartment.

3. The backpack set forth in claim 1 wherein the at least one panel comprises a front panel defining at least a portion of the interior compartment, the bodyside liner extending over at least a portion of the front panel.

4. The backpack set forth in claim 1 wherein the bodyside liner comprises a single-piece of material.

5. The backpack set forth in claim 1 further comprising an edge binding extending along at least a segment of the peripheral edge, the edge binding coupling the bodyside liner to at least one of the at least one panel or the pair of shoulder straps.

6. The backpack set forth in claim 1, wherein the bodyside liner comprises a mesh material.

7. The backpack set forth in claim 1, wherein the bodyside liner comprises at least one first area having a first weave configuration and at least one second area having a second weave configuration, the second weave configuration being different than the first weave configuration.

8. The backpack set forth in claim 1, wherein the bodyside liner comprises at least one first area having a first weave configuration and at least one second area having a second weave configuration different than the first weave configuration, wherein the first weave configuration and the second weave configuration are configured in a sequential pattern.

9. The backpack set forth in claim 1, wherein the bodyside liner comprises at least one first area having a first weave configuration and at least one second area having a second weave configuration different than the first weave configuration, wherein the first weave configuration and the second weave configuration are configured in an alternating pattern.

10. The backpack set forth in claim 1 further comprising an edge binding extending along a segment of the peripheral edge proximate to the pair of shoulder straps, the edge binding coupling the bodyside liner to the pair of shoulder straps.

11. The backpack set forth in claim 1 further comprising an edge binding extending along a segment of the peripheral edge proximate to the at least one panel, the edge binding coupling the bodyside liner to the at least one panel.

12. The backpack set forth in claim 1 further comprising an insert layer underlying the bodyside liner.

13. The backpack set forth in claim 1 further comprising an insert layer that comprises a body portion and a pair of strap portions separate from the body portion, the body portion extending between the bodyside liner and the bodyfacing surface of the at least one panel, the pair of strap portions extending between the bodyside liner and the pair of shoulder straps.

14. The backpack set forth in claim 1, wherein the bodyside liner comprises a body portion and a pair of strap portions, the body portion extending over the bodyfacing surface of the back panel, the pair of strap portions extending over the pair of shoulder straps.

15. The backpack set forth in claim 1 further comprising an insert layer that comprises a body portion and a pair of strap portions separate from the body portion, the body portion fabricated from a first material, the pair of strap portions fabricated from a second material different from the first material.

16. The backpack set forth in claim 1 further comprising a waistbelt that has yet another bodyfacing surface, wherein the bodyside liner further covers the bodyfacing surface of the waistbelt.

17. A one-piece bodyside liner for a pack including a back panel, a first shoulder strap, and a second shoulder strap, the one-piece bodyside liner comprising:

a body portion covering a bodyfacing surface of the pack, the body portion extending across at least the back panel, the first shoulder strap, and the second shoulder strap; and a peripheral edge portion circumscribing the body portion, the one-piece body liner coupled to the pack along at least a segment of the peripheral edge portion such that the body portion is free from attachment to the bodyfacing surface at one or more inboard seams.

18. The one-piece bodyside liner of claim 17 further comprising an edge binding extending along at least the segment of the peripheral edge portion.

19. The one-piece bodyside liner of claim 17, wherein at least the segment of the peripheral edge portion has a self-bound seam.

20. A method of assembling a pack, the method comprising:

coupling a first panel to a second panel to at least partially define an interior compartment adapted to store one or more objects for transport in the pack;

coupling a plurality of shoulder straps to one or more of the first panel or the second panel, the plurality of shoulder straps including a first shoulder strap and a second shoulder strap;

extending a single-piece bodyside liner across the pack such that an inboard portion of the single-piece bodyside liner substantially covers a bodyfacing panel surface of the first panel, a first bodyfacing strap surface of the first shoulder strap, and a second bodyfacing strap surface of the second shoulder strap; and coupling the single-piece bodyside liner to the pack along at least a segment of a peripheral edge portion of the single-piece bodyside liner circumscribing the inboard portion such that the inboard portion is free from attachment to the pack at one or more inboard seams to facilitate reducing a likelihood of skin irritation associated with use of the pack.

* * * * *